US009229397B2

(12) United States Patent
Yokoi

(10) Patent No.: US 9,229,397 B2
(45) Date of Patent: Jan. 5, 2016

(54) IMAGE FORMING APPARATUS

(75) Inventor: Junichi Yokoi, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 163 days.

(21) Appl. No.: 12/342,579

(22) Filed: Dec. 23, 2008

(65) Prior Publication Data

US 2009/0169260 A1 Jul. 2, 2009

(30) Foreign Application Priority Data

Dec. 27, 2007 (JP) ..... 2007-335915

(51) Int. Cl.
*B41J 15/14* (2006.01)
*G03G 15/04* (2006.01)
*G03G 15/32* (2006.01)

(52) U.S. Cl.
CPC ..... *G03G 15/326* (2013.01); *G03G 15/04054* (2013.01)

(58) Field of Classification Search
CPC ..... G03G 15/04054; G03G 15/326
USPC ..... 347/138, 263, 242; 399/177
See application file for complete search history.

(56) References Cited

U.S. PATENT DOCUMENTS 5,594,260 A * 1/1997 Tsutsui et al. ..... 257/80
5,886,728 A 3/1999 Hamada et al.
6,219,323 B1 * 4/2001 Fukatsu et al. ..... 720/650
6,226,027 B1 * 5/2001 Ashida et al. ..... 347/242
6,252,619 B1 * 6/2001 Ueda et al. ..... 347/138
6,809,752 B2 * 10/2004 Nagamine ..... 347/238
7,262,787 B2 * 8/2007 Park ..... 347/263
7,648,370 B2 * 1/2010 Azuma et al. ..... 439/67
7,982,761 B2 * 7/2011 Yokoi ..... 347/242
8,040,368 B2 10/2011 Yokoi
8,269,810 B2 * 9/2012 Saiki ..... 347/238
2003/0222968 A1 12/2003 Nagamine (Continued)

FOREIGN PATENT DOCUMENTS

JP 63-018367 1/1988
JP 9-152810 A 6/1997

(Continued)

OTHER PUBLICATIONS

Various anonymous, Paint, Sep. 30, 2010, Wikipedia, http://en.wikipedia.org/wiki/Paint.*

(Continued)

*Primary Examiner* — Julian Huffman
*Assistant Examiner* — Carlos A Martinez
(74) *Attorney, Agent, or Firm* — Banner & Witcoff, Ltd.

(57) ABSTRACT

An image forming apparatus is provided. The image forming apparatus includes: a photosensitive member; an exposing unit which is opposed to the photosensitive member, and which includes a plurality of light emitting elements arranged in an arrangement direction to expose the photosensitive member; and a body frame which is provided at both sides of the exposing unit in the arrangement direction. The body frame is made of a conductive member. The exposing unit includes an exposing unit body having an exterior made of a resin; and an electrically conductive holding member which is longer than the exposing unit body in the arrangement direction, and which holds the exposing unit body, wherein the holding member is electrically connected to the body frame to be grounded.

19 Claims, 7 Drawing Sheets

(56) References Cited

U.S. PATENT DOCUMENTS

| | | | | |
|---|---|---|---|---|
| 2004/0008333 | A1* | 1/2004 | Oda et al. | 355/55 |
| 2004/0228652 | A1* | 11/2004 | Fujiwara | 399/117 |
| 2005/0046912 | A1* | 3/2005 | Nobe et al. | 358/498 |
| 2007/0093092 | A1* | 4/2007 | Fang | 439/95 |
| 2007/0126852 | A1* | 6/2007 | Fukutome et al. | 347/262 |
| 2009/0162091 | A1* | 6/2009 | Yokoi | 399/90 |
| 2009/0169260 | A1* | 7/2009 | Yokoi | 399/177 |
| 2009/0169261 | A1 | 7/2009 | Yokoi | |
| 2009/0274488 | A1* | 11/2009 | Sugiyama | 399/217 |
| 2009/0322851 | A1* | 12/2009 | Yokoi et al. | 347/245 |
| 2010/0247198 | A1* | 9/2010 | Saiki et al. | 399/394 |
| 2011/0255905 | A1 | 10/2011 | Yokoi | |

FOREIGN PATENT DOCUMENTS

| | | | | | |
|---|---|---|---|---|---|
| JP | 2001217988 | A | * | 8/2001 | H04N 1/00 |
| JP | 2003-341134 | A | | 12/2003 | |
| JP | 2006-088598 | | | 4/2006 | |
| JP | 2006263985 | A | | 10/2006 | |
| JP | 2006289843 | A | * | 10/2006 | |
| JP | 2007-271734 | A | | 10/2007 | |
| JP | 2009-157001 | A | | 7/2009 | |
| JP | 2009-157142 | A | | 7/2009 | |

OTHER PUBLICATIONS

JP Office Action dtd Aug. 21, 2012, JP Appln. 2007-335915, English translation.

* cited by examiner

IMAGE FORMING APPARATUS

CROSS-REFERENCE TO RELATED APPLICATION

This application claims priority from Japanese Patent Application No. 2007-335915, filed on Dec. 27, 2007, the entire subject matter of which is incorporated herein by reference.

TECHNICAL FIELD

Aspects of the present invention relate to an image forming apparatus in which a photosensitive member and an exposing unit are placed in close proximity to each other.

BACKGROUND

An image forming apparatus includes a photosensitive member which is exposed while placing the photosensitive member and a light emitting face of an exposing unit, for example, an Light Emitting Diode (LED) head in close proximity.

To such exposing unit, a large current for light emitting is flown. In order to prevent peripheral devices from being adversely affected by generation of electromagnetic waves, and therefore, a body of the exposing unit has to be grounded.

In the apparatus described in JP-A-2006-088598, a coil spring is in contact with an LED body, and an LED head is electrically grounded from the coil spring through a plate spring, a ground wire and a body frame.

However, the grounding technique described in JP-A-2006-088598 can be applied to the case where the LED body is made of an electrically conductive material such as a metal, however, cannot be applied to the case where the exterior is made of a resin. Furthermore, the grounding system configured by the coil spring is not sufficient to absorb electromagnetic waves which may be generated from the LED body.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus in which grounding of an exposing unit having a resin-made exterior can be sufficiently realized, and electromagnetic waves that may be possibly generated from the exposing unit can be absorbed.

According to an exemplary embodiment of the present invention, there is provided an image forming apparatus including: a photosensitive member; an exposing unit which is opposed to the photosensitive member, and which includes a plurality of light emitting elements arranged in an arrangement direction to expose the photosensitive member; and a body frame which is provided at both sides of the exposing unit in the arrangement direction. The body frame is made of a conductive member. The exposing unit includes: an exposing unit body having an exterior made of a resin; and an electrically conductive holding member which is longer than the exposing unit body in the arrangement direction, and which holds the exposing unit body, wherein the holding member is electrically connected to the body frame to be grounded.

According to another exemplary embodiment of the present invention, there is provided an image forming apparatus includes: a photosensitive drum; an exposing unit which extends in a direction, and which includes: an emitting portion which emits light; and a electrically conductive holding member which holds the emitting portion and protrudes from both sides of the emitting portion in the direction; and a conductive metal frame provided at both sides of the exposing unit in the direction. The photosensitive drum and the exposing unit are relatively movable between an exposing position where the emitting portion is opposed to the photosensitive drum and a retracted position where the emitting portion is not opposed to the photosensitive drum. The holding member is electrically connected to the metal frame at both sides of the exposing unit in the direction when the exposing unit is at the exposing position.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 2:
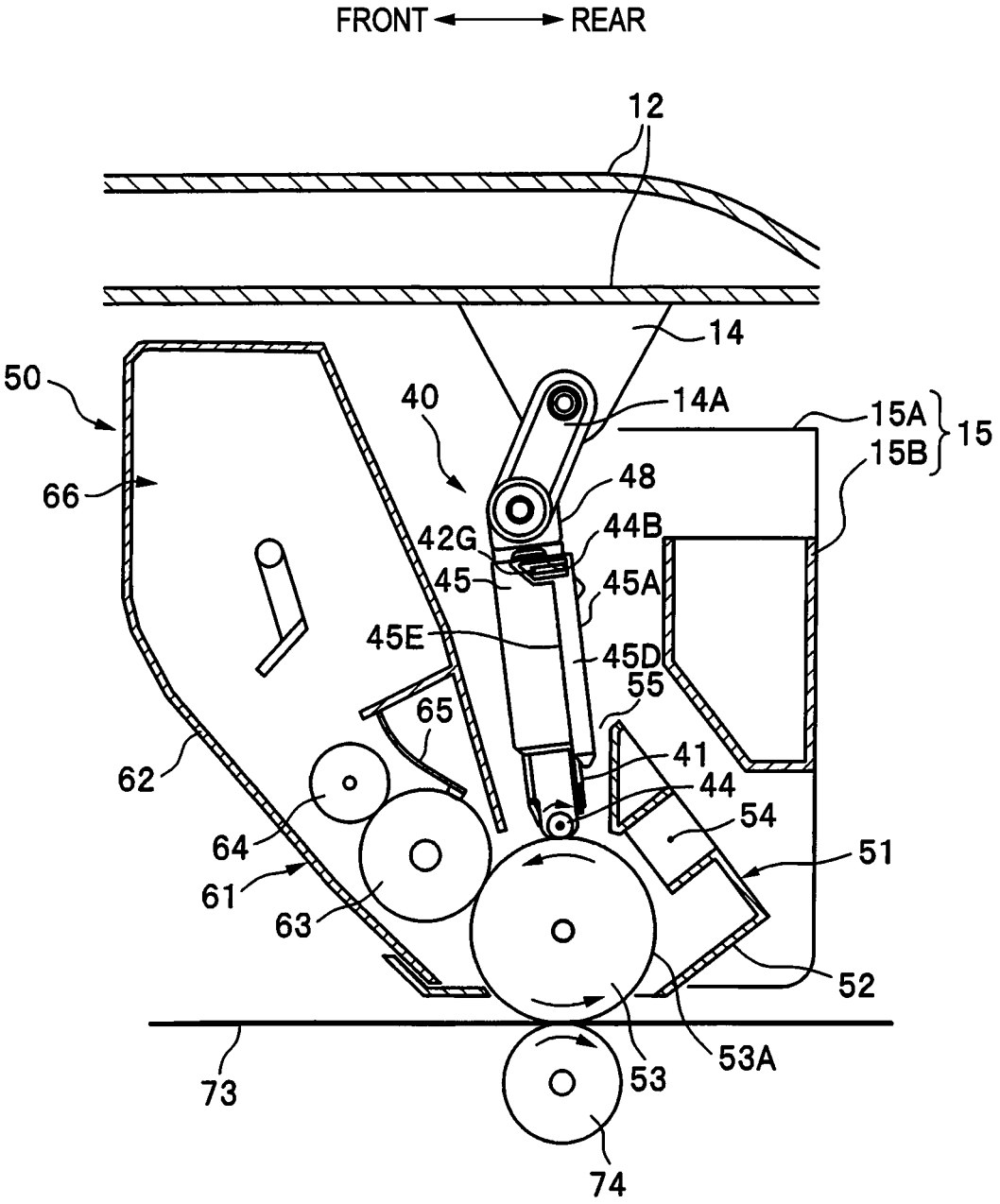
FIG. 2 is an enlarged view of an LED unit and a process cartridge shown in FIG. 1.
Figures 3A, 3B:
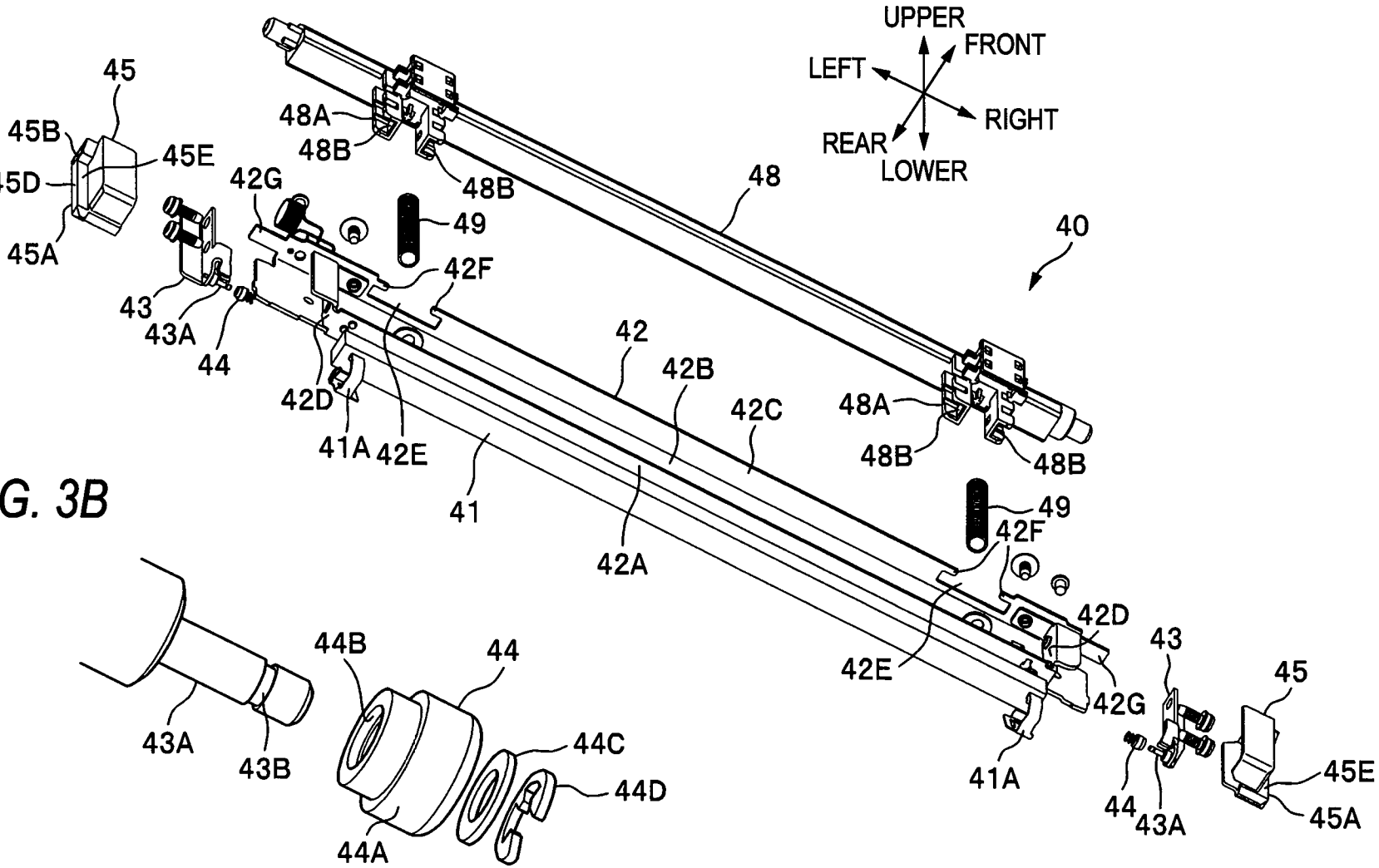
FIG. 3A is an exploded perspective view of the LED unit.
FIG. 3B is an enlarged perspective view of a guide roller.
Figure 4:
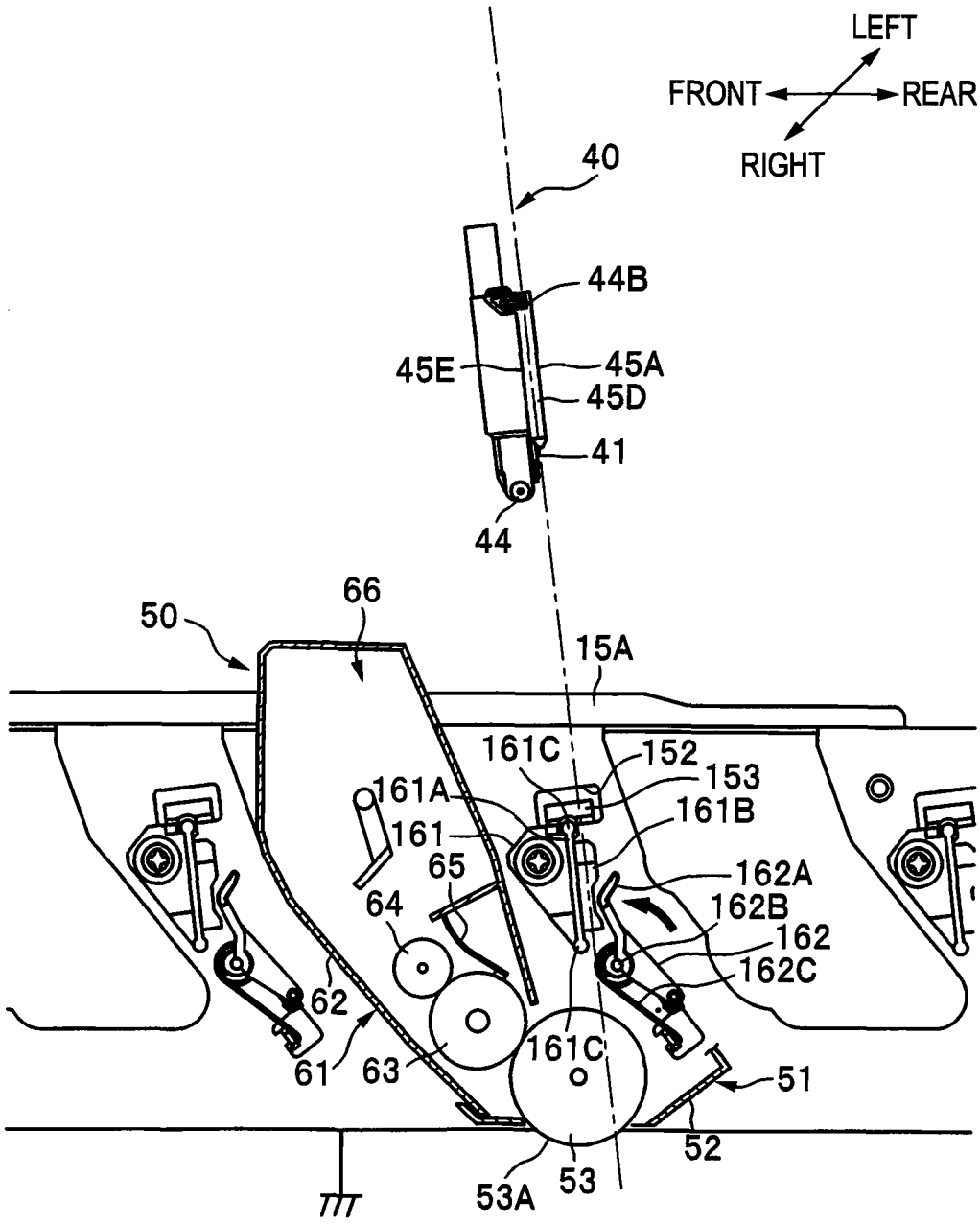
FIG. 4 is a side view showing the positional relationship between the LED unit and a side section of an exposure frame.
Figure 5:
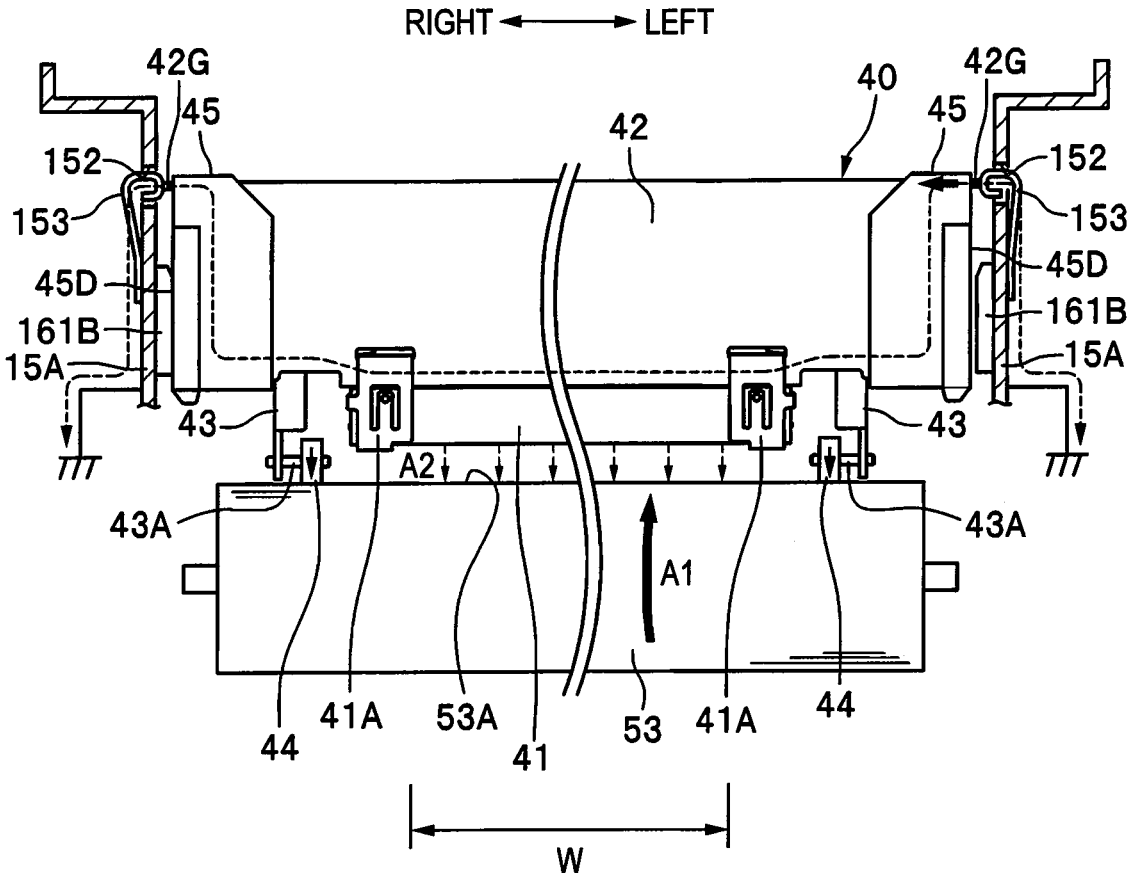
FIG. 5 is a view in which a photosensitive drum and the LED unit are seen from the rear side.

Next, an exemplary embodiment of the present invention will be described in detail with reference to the drawings. Among the drawings to be referred, FIG. 1 is a section view showing the overall configuration of a color printer, FIG. 2 is an enlarged view of an LED unit and process cartridge shown in FIG. 1, FIG. 3A is an exploded perspective view of the LED unit, FIG. 3B is an enlarged perspective view of a guide roller, FIG. 4 is a side view showing the positional relationship between the LED unit and a side section of an exposure frame, and FIG. 5 is a view in which a photosensitive drum and the LED unit are seen from the rear side.

In the following description, the indication of the direction will be made with reference to the user using the color printer. That is, in FIG. 1, it is assumed that when viewing the figure, the left side is "front side", the right side is "rear side", the back side is "left side", and the front side is "right side". Furthermore, it is assumed that the vertical direction when viewing the figure is "vertical (upper-lower) direction".

Figure 1:
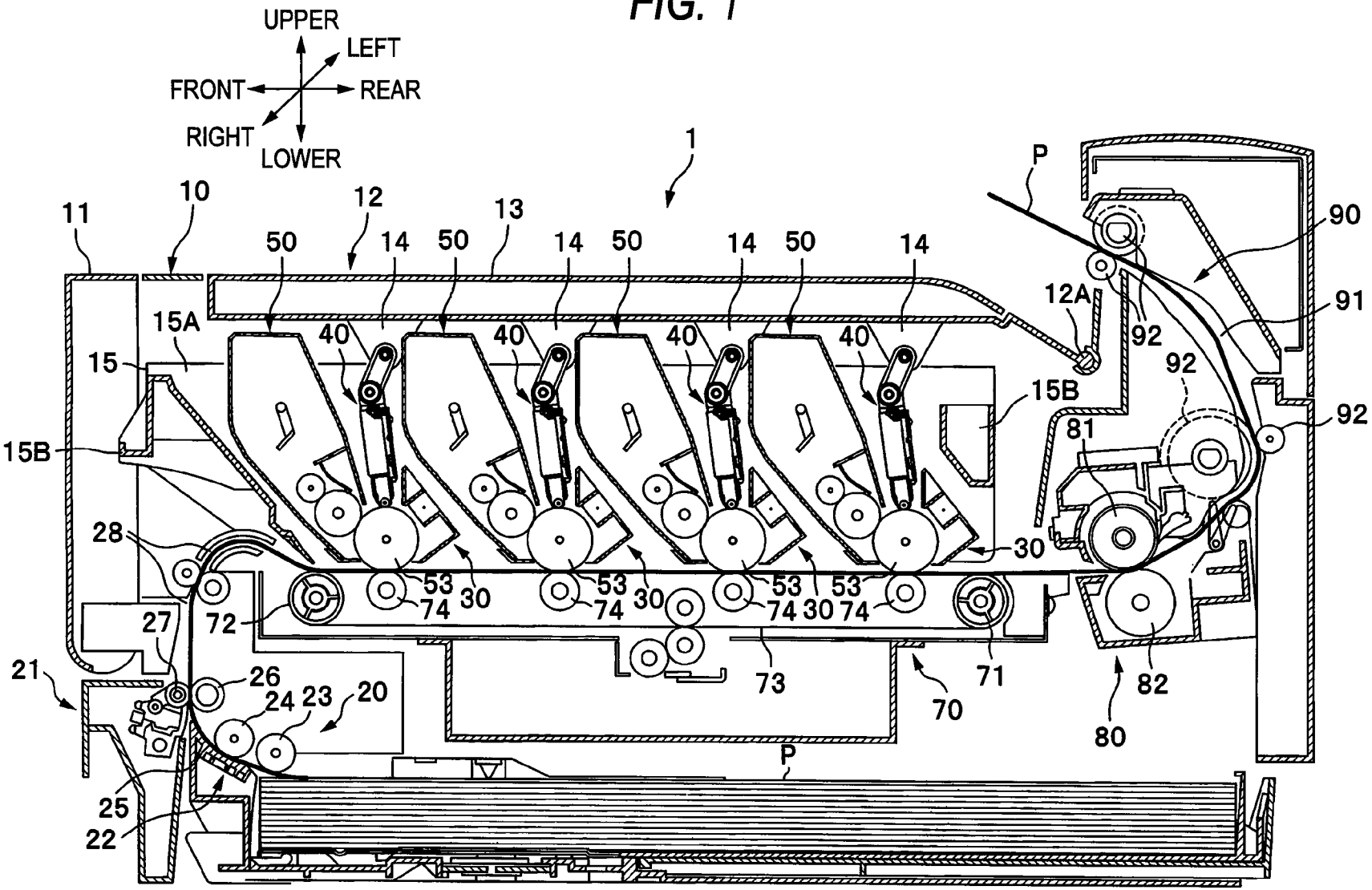
FIG. 1 is a section view showing the overall configuration of a color printer according to an exemplary embodiment of the present invention.

As shown in FIG. 1, the color printer 1 includes in a body case 10; a sheet feeding unit 20 which feeds a sheet P; an image forming unit 30 which forms an image on the fed sheet P; and a sheet discharging unit 90 which discharges the sheet P on which an image is formed.

In an upper portion of the body case 10, an upper cover 12 which is openable and closable with respect to the body case 10 is disposed to be vertically pivotable about a hinge 12A disposed at the rear side. The upper face of the upper cover 12 serves as a sheet discharging tray 13 on which sheets P discharged from the body case 10 is stacked, and. The lower face of the upper cover is provided with plural LED attaching members 14 for holding LED units 40 are provided, which will be described later.

A body frame 15 which detachably accommodates process cartridges 50 (described later) and which constitutes a part of the apparatus body is disposed in the body case 10. The body frame 15 includes a pair of metal side frames 15A (a "first frame" and a "second frame") which are disposed in the right and left sides (only one frame is shown), and a pair of front and rear cross members 15B (a "third frame") which couple the pair of side frames 15A with each other. The body frame 15 is fixed to the body case 10 and the like. The side frames 15A are placed respectively on the both sides of an arrangement direction of light emitting elements of LED heads 41 which will be described later and directly or indirectly support and position the photosensitive drums 53. The direction along which the light emitting elements are arranged is referred to a main direction. In the exemplary embodiment, the direction coincides with an axial direction of each of the photosensitive drums 53.

The sheet feeding unit 20 includes: a sheet feeding tray 21 which is disposed in a lower portion of the body case 10, and which is detachably attached to the body case 10; and a sheet feeding mechanism 22 which conveys the sheet P from the sheet feeding tray 21 to the image forming unit 30. The sheet feeding mechanism 22 is disposed in front of the sheet feeding tray 21, and includes a feed roller 23, a separation roller 24, and a separation pad 25.

In thus configured sheet feeding unit 20, sheets P in the sheet feeding tray 21 are upwardly fed while being individually separated from one another, paper dusts are removed away during a process in which the sheet P is passed between a paper dust removing roller 26 and a pinch roller 27, and then the sheet is passed through a conveying path 28 to convert the direction of the sheet to the rearward direction, and fed to the image forming unit 30.

The image forming unit 30 includes four LED units 40, four process cartridges 50, a transferring unit 70, and a fixing unit 80.

The four process cartridges 50 are arranged in the longitudinal direction between the upper cover 12 and the sheet feeding unit 20. As shown in FIG. 2, each of the cartridges includes a drum unit 51, and a developing unit 61 which is detachably attached to the drum unit 51. The process cartridges 50 are supported by the side frames 15A, and the photosensitive drums 53 are supported by the process cartridges 50, respectively. The process cartridges 50 have the same configuration but are different with each other in colors of toners housed in respective toner housing chambers 66 of the developing units 61.

The drum unit 51 includes a drum frame 52, the photosensitive drum 53 which is rotatably supported by the drum frame 52, and a scorotron charger 54.

The developing unit 61 includes a developing frame 62, a developing roller 63 and supplying roller 64 which are rotatably supported by the developing frame 62, and a layer-thickness restricting blade 65, and has the toner housing chamber 66 which houses the toner. In the process cartridge 50, the developing unit 61 is attached to the drum unit 51, whereby an exposing space 55 through which the photosensitive drum 53 can be seen from the upper side is formed between the developing frame 62 and the drum frame 52. The LED unit is inserted through the exposing space 55.

As shown in FIG. 1, the transferring unit 70 is disposed between the sheet feeding unit 20 and the process cartridges 50. The transferring unit 70 includes a driving roller 71, a driven roller 72, a conveyor belt 73, and transfer rollers 74.

The driving roller 71 and the driven roller 72 are placed in parallel while being separated from each other in the longitudinal direction. The conveyor belt 73 configured by an endless belt is wound around the driving roller 71 and the driven roller 72. The outer surface of the conveyor belt 73 is in contact with the photosensitive drums 53. Inside the conveyor belt 73, four transfer rollers 74 which cooperate with the photosensitive drums 53 to sandwich the conveyor belt 73 are placed so as to be opposed to the respective photosensitive drums 53. During a transfer process, a transfer bias is applied to the transfer rollers 74 with a constant-current control.

The fixing unit 80 is placed rear side from the process cartridges 50 and the transferring unit 70, and includes a heating roller 81, and a pressing roller 82 which is opposed to the heating roller 81 to press the heating roller 81.

In thus configured image forming unit 30, first, the surface of each of the photosensitive drums 53 is uniformly charged by the scorotron charger 54, and then exposed by LED beams emitted from the corresponding LED unit 40. Therefore, the potential of the exposed portion is lowered, and an electrostatic latent image based on image data is formed on the photosensitive drum 53.

The toner in the toner housing chamber 66 is supplied to the developing roller 63 by rotation of the supplying roller 64, and caused by rotation of the developing roller 63 to enter between the developing roller 63 and the layer-thickness restricting blade 65 and carried on the developing roller 63 as a thin layer of a constant thickness.

When the developing roller 63 is opposed to and in contact with the photosensitive drum 53, the toner carried on the developing roller 63 is supplied to the electrostatic latent image formed on the photosensitive drum 53. Therefore, the toner is selectively carried on the photosensitive drum 53 to visualize the electrostatic latent image, and a toner image is formed by the reversal development.

Next, the sheet P fed onto the conveyor belt 73 is passed between the photosensitive drums 53 and the transfer rollers 74 placed inside the conveyor belt 73, so that the toner images formed on the photosensitive drums 53 are transferred to the sheet P.

When the sheet P is passed between the heating roller 81 and the pressing roller 82, the toner images transferred to the sheet P are thermally fixed thereto.

The sheet discharging unit 90 includes: a discharge conveying path 91 which is formed so as to upwardly extend from the outlet of the fixing unit 80, and to be then inverted toward the front side, and plural pairs of conveying rollers 92 which convey the sheet P. The sheet P onto which the toner images have been transferred, and which has undergone the thermal fixing process is conveyed through the discharge conveying path 91 by the conveying rollers 92, and then discharged to the outside of the body case 10 to be stacked on the sheet discharging tray 13.

<Configuration of LED Unit>

Next, the characteristic portions of the present invention, i.e., the LED units 40 and the configuration for grounding them will be described in detail.

Herein, the grounding a member refers to a state in which the member is electrically connected to the ground and also a state in which the member is electrically connected to a member having a large amount of capacitance such as the metal side frames 15A.

As shown in FIG. 3, each of the LED units 40 includes the LED head 41, an exposure frame 42, roller support members 43, guide rollers 44, resin covers 45, and a suspender 48.

The LED head 41 includes plural light emitting elements each configured by an LED arranged laterally in one row in the lower side. Specifically, the LED head 41 has a head configuration in which plural light emitting elements (LEDs) which are arranged in accordance with specific pixel pitches, and which are selectively driven to expose the surface of the photosensitive drum 53 are supported by a supporting member. Herein, the arrangement direction of the light emitting elements is referred to as the main direction, and the direction perpendicular to the main direction and perpendicular to the exposure direction (see an arrow A2 of FIG. 5) of the LEDs, specifically the longitudinal direction along which the photosensitive drums 53 are arranged is referred to as the sub direction. The LED head is longer in the main direction than in the sub direction. The exterior of the LED head 41 is formed by a resin, so that discharges from high-voltage components such as the scorotron charger 54 are suppressed. The light emitting elements receives a signal from a control device (not shown) on the basis of data of an image to be formed, and emits light to expose the photosensitive drum 53.

The exposure frame 42 supports the LED head 41. The exposure frame 42 is formed by pressing a metal plate into a substantially U-like section, and is electrically conductive. The exposure frame 42 is formed to be longer than the LED head 41 in the axial direction of the photosensitive drum 53, i.e., the lateral direction or the main direction. In other words, the exposure frame 42 is an elongated metal frame which protrudes from the LED head 41 at both sides in the main direction (i.e., from an imaginary plane that includes the first face of the head in the second direction). Specifically, the exposure frame 42 includes a lower section 42A, a side section 42B, and an upper section 42C to configure one member extending in the lateral direction and having the U-like section. In the both ends of the lower section 42A in the lateral direction (hereinafter, the ends are referred to simply as "the both ends"), end sections 42D are formed by bending end portions of the lower section 42A. In the upper section 42C, openings 42E which are opened in the front side are formed in the vicinities of the both ends. In the front side or opening end of each of the openings 42E, engaging hooks 42F which laterally extend toward the inner side of the opening 42E so as to narrow the opening 42E are formed. The upper face of the LED head 41 closely contacts and fixed to the lower section 42A of the exposure frame 42 by two clips 41A.

The both ends in the lateral direction of the upper section 42C of the exposure frame 42 outwardly project in the lateral direction to form grounding terminals 42G.

Each of the roller support member 43 is a bracket which is formed by press processing a conductive metal plate, and which is screwed to the corresponding one of the end sections 42D of the exposure frame 42. In the roller support member 43, a roller shaft 43A which laterally extends toward the inner side is disposed in the lower end. The roller shaft 43A rotatably supports the guide roller 44. As shown in FIG. 3B, an engaging groove 43B is formed in the circumference of the roller shaft 43A.

The guide roller 44 is a substantially cylindrical roller which is used for maintaining a gap between the LED head 41 and the photosensitive drum 53. Specifically, a rolling face 44A is formed into a cylindrical shape. A shaft hole 44B into which the roller shaft 43A is to be fitted is formed in the central axis of the rolling face 44A. The roller shaft 43A is passed through the shaft hole 44B, a washer 44C is inserted, and then a clip 44D is engaged with the engaging groove 43B, whereby the guide roller 44 is attached to the roller shaft 43A. That is, the extending direction of the roller shaft 43A coincides with the rotation axis direction of the guide roller 44.

As shown in FIG. 2, the guide roller 44 rolls while contacting with the peripheral face 53A of the photosensitive drum 53, to define the positional relationship between the LED unit 40 and the photosensitive drum 53, and specifically the gap between the light emitting elements of the LED head 41 and the peripheral face 53A. The material constituting the guide roller 44 is not particularly restricted. However, a material which has an adequate coefficient of friction with respect to the peripheral face 53A, and which has an excellent wear resistance, such as a polyamide resin may be used.

As shown in FIG. 5, in order to prevent the image formation from being influenced, the guide roller 44 is placed outside the image forming range W on the peripheral face 53A of the photosensitive drum 53, to which the toner is supplied.

The resin covers 45 cover metal portions in the both ends of the exposure frame 42. The resin covers 45 which are disposed respectively on the right and left sides are symmetrical. The resin covers 45 are configured by insulative resin members, and formed so as to cover the end faces of the exposure frame 42 and portions of a specific range from the both ends, respectively. Each of the resin covers 45 includes a guide rib 45A projecting outwardly from a lateral outer end portion and extending vertically. The upper end of the guide rib 45A has a substantially triangular profile as seen from the lateral end side. A through hole 45B is formed in the inner side of the triangular portion. The corresponding one of the grounding terminals 42G passes through the through hole 45B to be exposed therefrom.

Each of the lateral end faces of the guide ribs 45A has a main-direction positioning face 45D. The main-direction positioning faces 45D is configured to abut the side frame 15A in the main direction to position the LED unit 40 in the main direction. The front face of each of the guide rib 45A has a sub-direction positioning face 45E. The sub-direction positioning face 45E is configured to abut the side frame 15A in the sub direction to position the LED unit 40 in the sub direction.

The suspender 48 supports the exposure frame 42 and the LED head 41 in a suspended state. The suspender 48 is formed so that the lateral length is equal to that of the exposure frame 42. The suspender includes an engaging member 48A disposed at two positions respectively corresponding to the two openings 42E. Each of the engaging members 48A includes a portions which has a U-like section shape, and which are opened to the laterally outer side as seen from the lower side. A opening 48B of the U-like section is loosely engaged with the corresponding engaging hook 42F.

Compression springs 49 are placed between the engaging members 48A and the exposure frame 42, respectively. The compression springs 49 are placed laterally inside the respective two guide rollers 44. After the engaging members 48A are loosely engaged with the openings 42E and engaging hooks 42F of the exposure frame 42, they are locked by locking members which are not shown, and then the exposure frame 42 and the LED head 41 are always downwardly urged by the compression springs 49.

As shown in FIG. 2, the LED unit 40 is attached to the upper cover 12 through a connecting link 14A and an LED attaching member 14. In connecting portions between the connecting link 14A, and the LED attaching member 14 and the LED unit 40, the connecting link is pivotable in a side view of FIG. 2. According to this configuration, the posture of the LED unit 40 can be freely changed. Therefore, the LED unit 40 can be easily engaged with the side frames 15A.

In the state where the LED unit 40 is attached to the upper cover 12, the LED unit downwardly extends from the upper cover 12. As described above, since the upper cover 12 is pivotable about the hinge 12A of the rear side so as to be openable and closable, the photosensitive drum 53 and the LED unit 40 can be relatively moved between an exposing position where the photosensitive drum 53 and the LED unit 40 are close to each other (opposed to each other), and a retracted position where the photosensitive drum 53 and the LED unit 40 are separated from each other. In the LED unit 40, at the exposing position, the guide rollers 44 disposed in the lower end abuts the upper end of the peripheral face 53A of the photosensitive drum 53, whereby the distance between the peripheral face 53A and the LED head 41 is kept constant.

As shown in FIG. 4, each of the side frames 15A has a front guide 161 and a rear guide 162 correspondingly to the end portion of each of the four LED units 40 at the exposing position. The front guide 161 is placed in front of the sub-direction positioning face 45E, and the rear guide 162 is placed behind the sub-direction positioning face 45E.

In the front guide 161 includes a rib 161A projecting laterally inwardly and extending substantially vertically. When the LED unit 40 is mounted to take the exposing position, the rib 161A is positioned in front of the guide rib 45A. The rib 161A includes columnar portions 161C at upper and lower end portions thereof. Each of the columnar portions 161C has a columnar shape which is laterally thicker than a middle portion of the rib 161A. The columnar portions 161C abut the sub-direction positioning face 45E to position the LED unit 40 in the sub direction. The front guide 161 includes an abutting portion 161B provided on the rear edge thereof along the rib 161A. The abutting portion 161B has a face which the main-direction positioning face 45D of the LED unit 40 abuts. A right-side abutting portion 161B abuts the LED unit 40 at one end to restrict the lateral position of the LED unit 40.

An arm 162A which extends from the lower side toward the upper side is disposed on the rear guide 162. The arm 162A is pivotably supported at a shaft 162B by a metal plate of the side frame 15A. A torsion spring 162C is disposed in the periphery of the shaft 162B so that an urging force in a counterclockwise direction in FIG. 4 is always applied to the arm 162A by the torsion spring 162C. The arm 162A and torsion spring 162C together define a first urging member.

Both the front and rear guides 161, 162 are made of a resin, whereby abrasion due to sliding contact with the LED unit 40 is suppressed.

In each of the side frames 15A, an opening 152 corresponding to the grounding terminal 42G of the LED unit 40 at the exposing position is formed substantially above the abutting portion 161B. As shown in FIG. 5, a plate spring 153 which is formed by bending a conductive metal plate is disposed in the opening 152. The plate spring 153 abuts the grounding terminal 42G of the LED unit 40 so that the plate spring 153 is bent to generate an urging force in the lateral inner direction. The plate spring 153 at the left side (the right one in FIG. 5, defining a second urging member) is thicker than the plate spring 153 at the right side (the left one in FIG. 5, defining a third urging member) so as to exert a larger urging force. As shown in FIGS. 4 and 5, the side frames 15A are electrically grounded.

Figure 6:
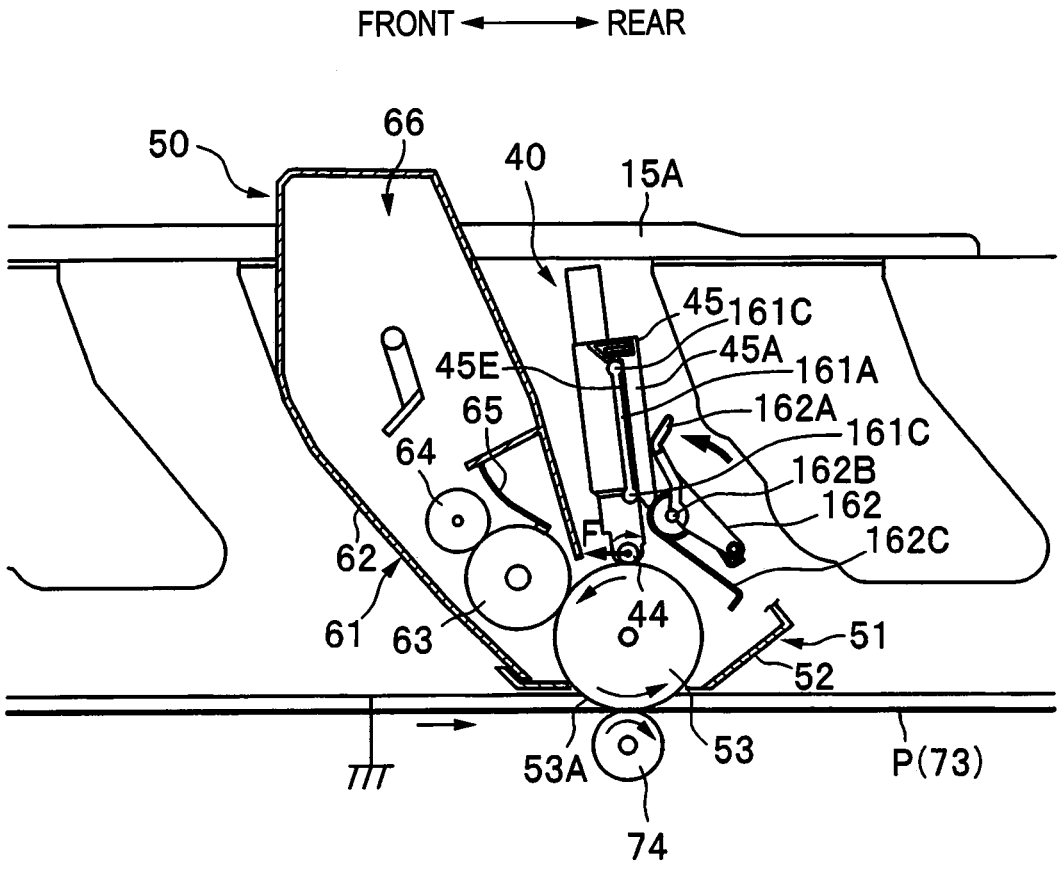
FIG. 6 is a view illustrating the positioning in a sub direction in the case where the LED unit is positioned at an exposing position.

The operation and effect of the thus configured color printer 1 according to the exemplary embodiment of the present invention will be described below. In the figures to be referred, FIG. 6 is a view illustrating the positioning in the sub direction in the case where the LED unit is positioned at the exposing position. In FIG. 6, in order to illustrate the engagement state between the front guides 161 (the ribs 161A) and the LED unit 40 and the engagement state between the rear guides 162 and the LED unit 40, the components are schematically shown in a manner different from the actually viewed state.

When one of the process cartridges 50 of the color printer 1 is to be replaced or on a maintenance process, the upper cover 12 is upwardly pivoted to the open position, and the corresponding LED unit 40 is then moved from the exposing position to the retracted position.

In the color printer 1 of the exemplary embodiment, the LED unit 40 is movable between the exposing position and the retracted position with respect to the photosensitive drum 53 in this way. Therefore the LED unit 40 has to be positioned with respect to the photosensitive drum 53.

When the maintenance is finished, the upper cover 12 is downwardly pivoted to the close position. At this time, as shown in FIG. 2, the guide rollers 44 which are at the tip end (lower end) of the LED unit 40 abut the peripheral face 53A of the photosensitive drum 53, whereby the distance between the peripheral face 53A and the light emitting elements of the LED head 41 is kept constant.

In the LED unit 40 inserted to the exposing position, as sown in FIG. 5, the right and left grounding terminals 42G abut the respective plate springs 153, and urged laterally inwardly from the both sides. Since the urging force of the left plate spring 153 is larger than that of the right plate spring 153, the LED unit 40 is shifted rightwardly as a whole, and the right abutting portion 161B abuts the right main-direction positioning face 45D so that the LED unit 40 is positioned in the main direction.

As shown in FIG. 6, the guide rib 45A is inserted between the rib 161A and the arm 162A. The arm 162A is pivoted about the shafts 162B by the torsion springs 162C, and urged in a counterclockwise direction in FIG. 6, i.e., in the forward direction, so that the guide rib 45A is forwardly urged. Therefore, the sub-direction positioning face 45E of the guide rib 45A abuts the columnar portions 161C provided at the both ends of the rib 161A, thereby positioning the LED unit 40 in the sub direction.

In the above-described positioning in the main direction, in the exposure frame 42, the grounding terminals 42G contact the plate springs 153, respectively, and the plate springs 153 are electrically grounded through the side frames 15A, respectively. Even when the LED head 41 in which the exterior is formed by a resin is used as in the exemplary embodiment, the LED head 41 can be grounded through the metal exposure frame 42 which is in close contact with the upper face of the LED head 41. This allows charges generated in the surface of the LED head 41 to be sufficiently removed away. Furthermore, the exposure frame 42 is formed so as to be laterally larger than the LED head 41, and the metal side frames 15A are disposed on the both lateral sides of the LED head 41. Therefore, even when a large current flows through the LED head 41 and electromagnetic waves are generated, the electromagnetic waves are sufficiently absorbed, so that influences of the electromagnetic waves on the other devices can be suppressed. In the exemplary embodiment, particularly, the above-described configuration is employed on the both lateral sides, and therefore, grounding and absorption of electromagnetic waves can be sufficient. Furthermore, in the exemplary embodiment, the grounding terminals 42G are used in the positioning in the main direction, and hence positioning and grounding of the LED head 41 and blocking of electromagnetic waves can be done without additional components. Since the exterior of the LED head 41 is made of a resin, the LED head 41 can be miniaturized, and the degree of freedom in the layout around the photosensitive drum 53 is enhanced, whereby the size of the color printer 1 can be reduced.

While the present invention has been shown and described with reference to certain exemplary embodiments thereof, it will be understood by those skilled in the art that various changes in form and details may be made therein without departing from the spirit and scope of the invention as defined by the appended claims.

Figure 7:
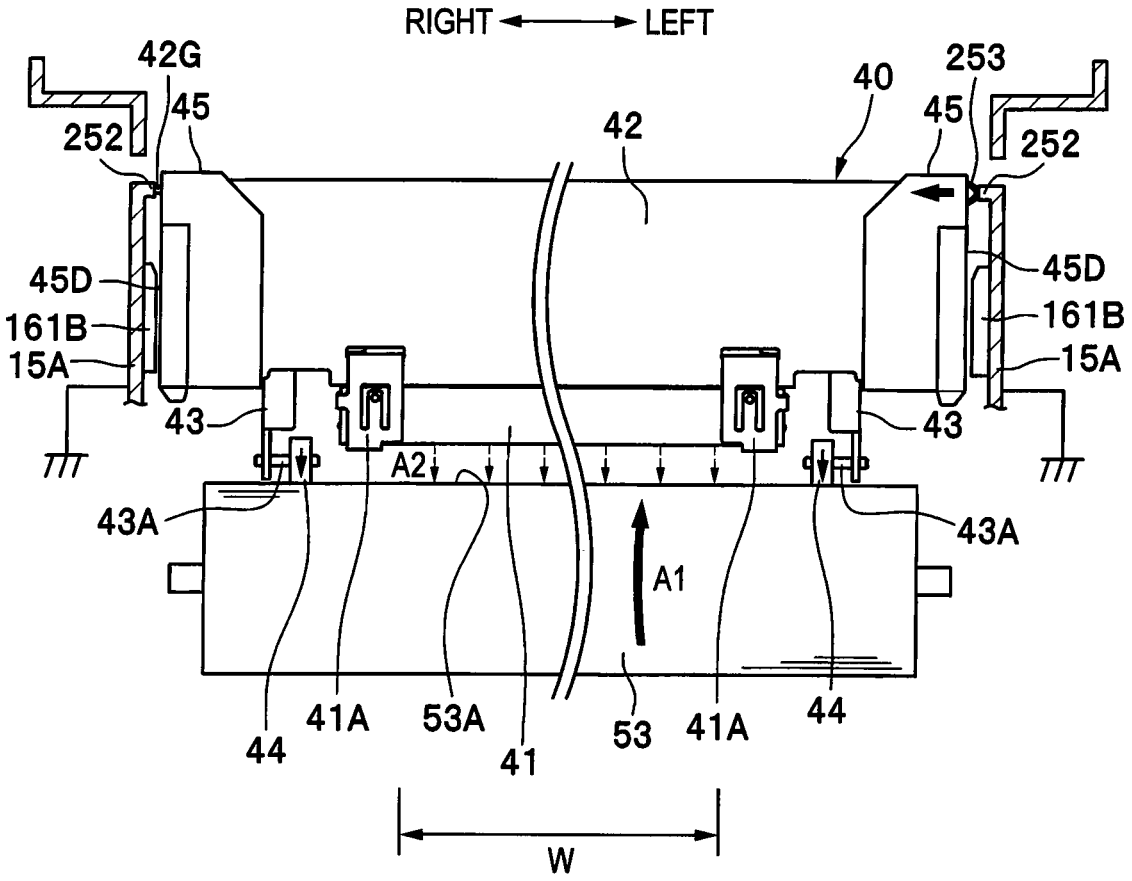
FIG. 7 is a view of an example in which a mechanism of positioning in a main direction is changed, and which corresponds to FIG. 5.

For example, FIG. 7 is a view of an example in which the mechanism of positioning in the main direction is changed, and which corresponds to FIG. 5. The components which are not described below are configured in the same manner as the above-described exemplary embodiment. In the example of FIG. 7, the plate spring 153 on the right side (the left side in FIG. 7) is omitted, and the side frame 15A is bent laterally inwardly to form an abutting portion 252 at a position corresponding to the grounding terminal 42G. Moreover, the plate spring 153 on the left side (the right side in FIG. 7) is omitted, an abutting portion 252 is formed in the same manner as the right side. In the left side, a metal plate spring 253 which projects outwardly from the through hole 45B is attached to the exposure frame 42. In this configuration, the LED unit 40 is rightwardly urged by the urging force of the plate spring 253, so that the positioning in the main direction is performed and at the same time grounding of the LED head 41 is ensured. Specifically, in the right side, the LED unit is grounded via the exposure frame 42, the grounding terminal 42G and the abutting portion 252, and, in the left side, the LED unit is grounded via the exposure frame 42, the plate spring 253 and the abutting portion 252.

In the exemplary embodiment plural LEDs as the plural light emitting elements are described. In order to configure the plural light emitting elements, alternatively, only one light emitting element such as an LED may be used. For example, one back light such as a fluorescent lamp may be provided, and an optical shutter in which liquid crystal devices or PLZT elements are laterally arranged in one row may be disposed in front of the back light. That is, the plural light emitting elements which are laterally arranged in one row can be configured by combining a single light emitting element and the optical shutter arranged in a row. The light emitting elements may be laterally arranged not only in one row, but may be arranged in plural rows. The light emitting elements are not restricted to LEDs, and may be organic electroluminescence diodes (OLEDs), fluorescence elements, or the like.

The side frames 15A (the body frame 15) which are placed on the both sides of the photosensitive drum 53 may be configured by frames themselves of the color printer 1. Further, if the color printer 1 is provided with a drawer which removably mounts thereon the plural process cartridges 50 and is drawable to outside from the color printer 1, frames of the drawer may serve as the side frames 15A according to the exemplary embodiment.

Although, in the exemplary embodiment, the photosensitive drum 53 is employed as a photosensitive member, the present invention is not limited to this. Alternatively, a belt-like photosensitive member may be employed.

What is claimed is:

1. An image forming apparatus comprising:

a photosensitive member;

an exposing unit facing the photosensitive member, the exposing unit including:

an exposing head including a resin exterior and a plurality of light emitting elements arranged in a first direction, each of the plurality of light emitting elements configured to emit light toward the photosensitive member in a second direction perpendicular to the first direction;

an elongated metal frame that is longer than the exposing head in the first direction and includes a first frame edge in the first direction and a second frame edge opposite to the first frame edge in the first direction;

a first protrusion protruding from the elongated metal frame toward the photosensitive member, the first protrusion being disposed between the exposing head and the first frame edge in the first direction; and a second protrusion protruding from the elongated metal frame toward the photosensitive member, the second protrusion being disposed between the exposing head and the second frame edge in the first direction; and a first positioning portion disposed between the first protrusion and the first frame edge in the first direction;

a first guide positioned outside of the exposing unit and disposed on one side relative to the exposing unit in a third direction perpendicular to the first direction and the second direction, the first guide contacting the first positioning portion; and a first urging member positioned outside of the exposing unit and disposed on an other side relative to the exposing unit in the third direction, the first urging member configured to urge the first positioning portion toward the first guide in the third direction.

2. The image forming apparatus according to claim 1, further comprising:

a body frame including:

a first frame made of metal; and a second frame made of metal;

wherein the exposing unit is disposed between the first frame and the second frame in the first direction, and wherein one side of the elongated metal frame in the first direction is electrically connected to the first frame to be grounded, and an other side of the elongated metal frame in the first direction is electrically connected to the second frame to be grounded.

3. The image forming apparatus according to claim 2, further comprising:

a second urging member disposed at the first frame in the first direction, the second urging member configured to urge the exposing unit toward the second frame in the first direction, wherein the elongated metal frame is electrically connected to the first frame via the second urging member to be grounded.

4. The image forming apparatus according to claim 3, further comprising a third urging member disposed at the second frame in the first direction, the third urging member configured to urge the exposing unit toward the first frame in the first direction, wherein the elongated metal frame is electrically connected to the second frame via the third urging member to be grounded, and wherein an urging force of the second urging member in the first direction is larger than an urging force of the third urging member in the first direction.

5. The image forming apparatus according to claim 3, wherein the second urging member protrudes to the exposing unit from the first frame.

6. The image forming apparatus according to claim 1,
wherein the exposing head includes a supporting member which supports the plurality of light emitting elements to be arranged in accordance with pixel pitches, and
wherein the plurality of light emitting elements are configured to be selectively driven to expose a surface of the photosensitive member.

7. The image forming apparatus according to claim 1,
wherein the photosensitive member has a cylindrical drum shape rotatable about a rotating axis extending in the first direction.

8. The image forming apparatus according to claim 1, wherein each of the light emitting elements includes a light emitting diode.

9. The image forming apparatus according to claim 1,
wherein a length of the exposing unit in the first direction is longer than a length of the exposing unit in the second direction, and
wherein a length of the exposing unit in the first direction is longer than a length of the exposing unit in the third direction.

10. The image forming apparatus according to claim 1, further comprising:
a body frame which is provided at both sides of the exposing unit in the first direction,
wherein the exposing unit includes a second urging member provided at one end of the exposing unit in the first direction and connected to the elongated metal frame,
wherein the second urging member abuts the body frame at one side in the first direction, and
wherein the elongated metal frame abuts the body frame at an other side in the first direction.

11. The image forming apparatus according to claim 1,
wherein the exposing head has a first face facing the photosensitive member and a second face which is opposite from the first face, and
wherein the elongated metal frame is configured to hold the second face of the exposing head, and the first face of the exposing head is spaced from the elongated metal frame.

12. The image forming apparatus according to claim 1, further comprising:
a body frame which is made of a conductive member,
wherein the elongated metal frame is an electrically conductive member, and the elongated metal frame is electrically connected to the body frame.

13. The image forming apparatus according to claim 12,
wherein the elongated metal frame is electrically connected to the body frame at both sides in the first direction to be grounded.

14. The image forming apparatus according to claim 13, further comprising
a second urging member disposed at one side of the body frame in the first direction, the second urging member configured to urge the exposing unit toward an other side of the body frame in the first direction,
wherein the elongated metal frame is electrically connected to the body frame via the second urging member to be grounded.

15. The image forming apparatus according to claim 14, further comprising
a third urging member disposed at the other side of the body frame in the first direction, the third urging member configured to urge the exposing unit toward the one side of the body frame in first direction,
wherein the elongated metal frame is electrically connected to the body frame via the third urging member to be grounded, and
wherein an urging force of the second urging member in the first direction is larger than an urging force of the third urging member in the first direction.

16. The image forming apparatus according to claim 1,
wherein the photosensitive member is a photosensitive drum.

17. The image forming apparatus according to claim 1, further comprising:
a supporter supporting the elongated metal frame, the supporter being disposed opposite from the exposing head relative to the elongated metal frame, wherein a length of the supporter in the first direction is longer than a length of the exposing head in the first direction,
wherein the elongated metal frame is configured to move relative to the supporter from a first position to a second position, the second position is closer to the photosensitive member than the first position.

18. The image forming apparatus according to claim 1,
wherein the exposing unit further includes:
a second positioning portion disposed between the second protrusion and the second frame edge in the first direction,
wherein the image forming apparatus further comprises:
a second guide disposed on the one side relative to the exposing unit in the third direction, the second guide contacting the second positioning portion; and
a fourth urging member disposed on an other side relative to the exposing unit in the third direction, the fourth urging member configured to urge the second positioning portion toward the second guide in the third direction.

19. An image forming apparatus comprising:
a photosensitive member;
an exposing unit facing the photosensitive member, the exposing unit including:
an exposing head including a resin exterior and a plurality of light emitting elements arranged in a first direction, each of the plurality of light emitting elements configured to emit light toward the photosensitive member in a second direction perpendicular to the first direction;
an elongated metal frame that is longer than the exposing head in the first direction and includes a first frame edge in the first direction and a second frame edge opposite to the first frame edge in the first direction;
a first protrusion protruding from the elongated metal frame toward the photosensitive member, the first protrusion being disposed between the exposing head and the first frame edge in the first direction;
a second protrusion protruding from the elongated metal frame toward the photosensitive member, the second protrusion being disposed between the exposing head and the second frame edge in the first direction; and
a positioning portion disposed between the first protrusion and the first frame edge in the first direction;
a guide positioned outside of the exposing unit and disposed on one side relative to the exposing unit in a third direction perpendicular to the first direction and the second direction, the guide contacting the positioning portion; and
an urging member positioned outside of the exposing unit and disposed on other side relative to the exposing unit in the third direction, the urging member configured to urge the positioning portion toward the guide in the third direction.

* * * * *